US008584840B2

(12) United States Patent
Kim

(10) Patent No.: US 8,584,840 B2
(45) Date of Patent: Nov. 19, 2013

(54) DEVICE AND METHOD FOR STORING AND DISPENSING

(76) Inventor: Ernest Kim, Irvine, CA (US)

( * ) Notice: Subject to any disclaimer, the term of this patent is extended or adjusted under 35 U.S.C. 154(b) by 101 days.

(21) Appl. No.: 13/036,580

(22) Filed: Feb. 28, 2011

(65) Prior Publication Data

US 2012/0168327 A1 Jul. 5, 2012

Related U.S. Application Data

(60) Provisional application No. 61/460,559, filed on Jan. 3, 2011.

(51) Int. Cl.
*B65D 25/08* (2006.01)

(52) U.S. Cl.
USPC ..... 206/221; 206/219

(58) Field of Classification Search
USPC ..... 206/219, 221; 215/DIG. 8, 727
See application file for complete search history.

(56) References Cited

U.S. PATENT DOCUMENTS 4,386,696 A 6/1983 Goncalves
5,794,802 A 8/1998 Caola
6,113,257 A * 9/2000 Sharon et al. ..... 366/130
6,644,471 B1 11/2003 Anderson
6,921,087 B2 7/2005 Takahashi et al.
7,503,453 B2 3/2009 Cronin et al.
7,568,576 B2 8/2009 Sweeney, Jr. et al.
7,588,142 B1 * 9/2009 Bush ..... 206/221
7,614,496 B2 11/2009 Dvorak et al.
7,690,534 B2 4/2010 Revenu
7,861,854 B2 * 1/2011 Sharon et al. ..... 206/221
2003/0072850 A1 * 4/2003 Burniski ..... 426/115
2005/0016875 A1 1/2005 Rodriguez
2007/0074979 A1 4/2007 Cho
2007/0125668 A1 6/2007 Marshall
2008/0067084 A1 3/2008 Patterson et al.
2009/0321286 A1 12/2009 Frutin
2010/0012193 A1 1/2010 Anson et al.
2010/0025356 A1 2/2010 Lee et al.
2010/0276308 A1 11/2010 Lee et al.

* cited by examiner

*Primary Examiner* — Steven A. Reynolds
*Assistant Examiner* — King M Chu

(57) ABSTRACT

In one embodiment, a storing and dispensing cap is provided and includes a housing movably couplable to a container neck having a lip, a dispensing platform coupled to the housing, and a dispenser opening between an exterior edge of the dispensing platform and the housing. The dispenser opening is configured to be plugged by the lip of the container neck when the housing is coupled to the container neck, and the dispenser opening is configured to be unplugged when the housing is not coupled to the container neck. A storing and mixing system including such a cap, and a method of storing and mixing using such a cap are also provided.

33 Claims, 6 Drawing Sheets

DEVICE AND METHOD FOR STORING AND DISPENSING

CROSS-REFERENCE TO RELATED APPLICATIONS

This application claims the benefit of U.S. Provisional Application No. 61/460,559 filed Jan. 3, 2011, the full disclosure of which is incorporated by reference herein for all purposes.

BACKGROUND

1. Field of the Invention

The present disclosure relates, in general, to containers with caps and, more particularly, to containers having separate compartments in which at least two materials may be stored separately and then may be combined when it is desired to mix them.

2. Description of the Related Art

Many drugs, dyes, vitamins, minerals, enzymes, nutrients, herbs, flavorings, and other chemicals are frequently supplied in powder, granule, tablet, or crystal form and do not retain their stability, strength and effectiveness for long after they have been mixed in solution or suspension, a condition frequently necessary for their administration or other use. It is also important that admixtures of various chemicals be done under conditions wherein a measured amount of one chemical be added to a measured amount of the other chemical to insure that proper results are obtained with a minimum of waste.

For example, some vitamins are combined with an effervescent agent and added to liquid immediately prior to use in order to retain the effectiveness of the vitamins. If the vitamins were mixed with liquid and were not consumed within a short period of time, the vitamins would deteriorate and would be less effective after an extended storage period.

There are many other examples of materials or substances which have an extended shelf life when not mixed, but which must be utilized relatively soon after mixture to prevent deterioration. Various cosmetics, medications, hair dyes, pigments, epoxy adhesives, polishes, cleansing solutions and the like have the foregoing characteristics. For example, conventional hair dyes employ a base material with which a pigmented material or solution is mixed for immediate application on the hair. If the pigmented material is mixed with the base and allowed to stand, the mixture may rapidly deteriorate and thus become unusable.

Many products are, by their very nature, required to be used by the consumer shortly after their manufacture as they lose certain desirable characteristics within a short period of time. Yet, the product can be stored for extended periods of time if a reactive compound thereof is maintained separate from the base compound. In such case, the two compounds may be mixed together to form the desired product shortly before use. In marketing such goods, it is desirable that the reactive compound and the base compound be sold as part of the same package. From an aesthetic as well as a handling standpoint, it is desirable that a single package be utilized for maintaining such compounds separately.

For example, in the chemical, cosmetic and pharmaceutical industries it is often necessary to separately store two products which are not to be mixed until just before the resulting mixture is to be used because the properties of that mixture are not acceptable for the application envisaged except at the moment at which the mixture is formed. The stability of the mixture, for example, is a property which may vary in the course of time and may therefore have values which are most efficacious at the time the mixture is formed.

Another important field of use for containers of this type lies in the storage of foodstuffs and particularly beverages. Thus, a new flavoring, nutrient, additive, etc. constituted of dry ingredients, and being in the form of granular material, or a powder may have been developed for carbonated beverages which has significant potential consumer appeal in comparison with existing products, with the beverage, however, having a limited shelf life after the flavoring, nutrient, additive, etc., is mixed with the liquid or carbonated water present in the container. The additive has a lengthier shelf life when maintained in a dry condition and separate from the water or liquid, and with the product being more flavorful, nutritious, effective, etc. and marketable when stored in a container which maintains the additive and liquid in separate compartments and inaccessible to each other until opening of the container for the purpose of dispensing the beverage.

Many different types of packages have been designed having two compartments to enable product components to be kept separate until use. However, prior devices have required many moving parts that required connection, or they required the user to take several actions to combine the ingredients and then use the mixture, such as pushing down on a pushbutton in order to initiate the mixing of the ingredients, and then opening of a cap. Furthermore, if a seal was previously used, it may have required puncturing of the seal, which could become detached, be not fully punctured, or otherwise hinder the flow of reactants.

Furthermore, the types of structures used for many prior two-compartment containers are complicated and often subject to higher manufacture costs and additional assembly time. Many prior art containers have required a high degree of manufacturing accuracy in order to work as intended. For example, in series production of plastic objects at industrial levels, it can be difficult to obtain consistently accurate results which would guarantee a constantly correct and desired connection between elements requiring a high degree of manufacturing accuracy, such as for a cutting element and a frangible seal.

Further, some prior packages provide that the compartment stays in the mouth of the container even after a closure device or cap has been extracted and the separately stored materials have been mixed, which represents an obstacle which can interfere with the pouring-out or use of the mixture.

Further, some prior packages would not work well if it is important that the contents of the container are kept dry. One prior art package describes a plug that would fit into a dispenser opening and prevent the dry contents of the compartment from mixing with the liquid contents of the container. However, the plug is located in the center of the bottle neck, and during the bottling process when liquid is poured into the container, the plug itself would get wet and would then contaminate the contents of the compartment.

Thus, there remains a need to have two-compartment packages which keep the components separate until just before use, which allow the two components to be easily mixed together, and which are simple to manufacture and assemble.

SUMMARY

The present disclosure provides an advantageous package in which two or more separate components may be contained in a separated condition until just before use but which allow the separate components to be easily and efficiently mixed together.

In accordance with an embodiment, a storing and dispensing cap is provided. The cap includes a housing movably couplable to a container neck having a lip, a dispensing platform coupled to the housing, and a dispenser opening between an exterior edge of the dispensing platform and the housing. The dispenser opening is configured to be plugged by the lip of the container neck when the housing is coupled to the container neck, and the dispenser opening is configured to be unplugged when the housing is not coupled to the container neck.

In accordance with another embodiment, a storing and mixing system is provided, the system including a storing and dispensing cap as noted above in conjunction with a container including a reservoir and a neck having a lip.

In accordance with another embodiment, a method of storing and dispensing is provided, the method including providing a container including a reservoir and a neck having a lip, and providing a storing and dispensing cap. The storing and dispensing cap includes a housing movably couplable to the neck, a dispensing platform coupled to the housing, and a dispenser opening between an exterior edge of the dispensing platform and the housing. The method further includes coupling the housing of the cap to the neck to plug the dispenser opening with the lip of the neck.

Other objects and advantages will be more fully apparent from the following disclosure and appended claims.

BRIEF DESCRIPTION OF THE DRAWINGS

The foregoing and other objects and advantages of the inventive container constructed pursuant to the teachings of the present disclosure may be more readily understood by one skilled in the art, having reference to the following detailed description of preferred embodiments thereof, taken in conjunction with the accompanying drawings.

Figure 1B:
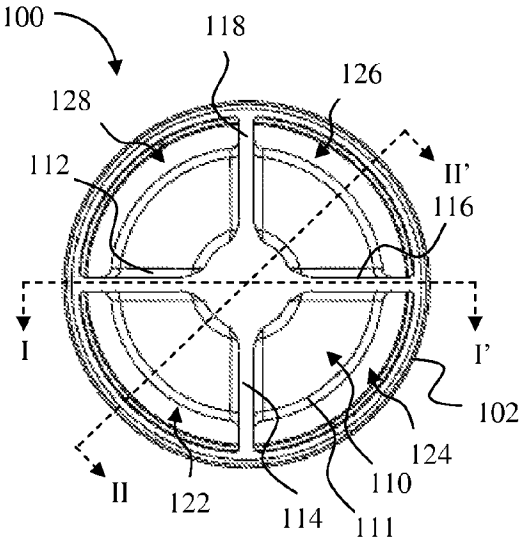
FIGS. 1B and 1C illustrate a top view and a side view, respectively, of the storing and dispensing cap of FIG. 1A in accordance with an embodiment of the present disclosure.

Embodiments of the present disclosure and their advantages are best understood by referring to the detailed description that follows. It should be appreciated that like reference numerals are used to identify like elements illustrated in one or more of the figures. It should also be appreciated that the figures may not be necessarily drawn to scale.

DETAILED DESCRIPTION

The present disclosure provides a storage and mixing apparatus allowing for the separate storage of at least two materials and the admixing of the materials upon "opening" of the apparatus. For ease of description, the dispensing structure of this disclosure is described in the normal (upright) operating position, and terms such as upper, lower, horizontal, etc., are used with reference to this position. It will be understood, however, that the dispensing structure of this disclosure may be manufactured, stored, transported, used, and/or sold in an orientation other than the position described.

Further, this description's terminology is not intended to limit the invention. For example, spatially relative terms, such as "beneath", "below", "lower", "above", "upper" "proximal", "distal", and the like, may be used to describe one element's or feature's relationship to another element or feature as illustrated in the figures. These spatially relative terms are intended to encompass different positions and orientations of the device in use or operation in addition to the position and orientation shown in the figures. For example, if the device in the figures is turned over, elements described as "below" or "beneath" other elements or features would then be "above" or "over" the other elements or features. Thus, the exemplary term "below" can encompass both positions and orientations of above and below. The device may be otherwise oriented (rotated 90 degrees or at other orientations), and the spatially relative descriptors used herein interpreted accordingly. In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically, directly coupled, or they may be indirectly coupled via one or more intermediate components.

Figure 1A:
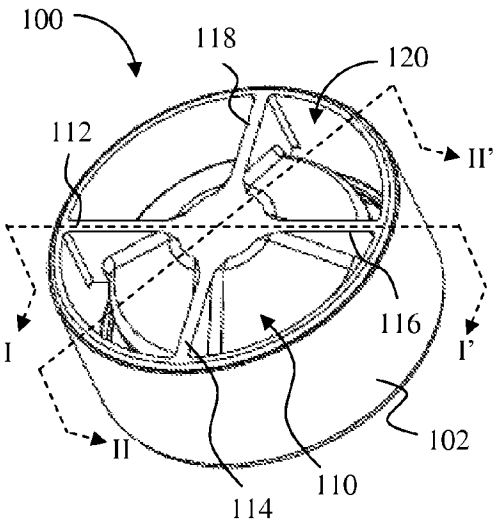
FIG. 1A illustrates a top perspective view of a storing and dispensing cap in accordance with an embodiment of the present disclosure.
Figure 1E:
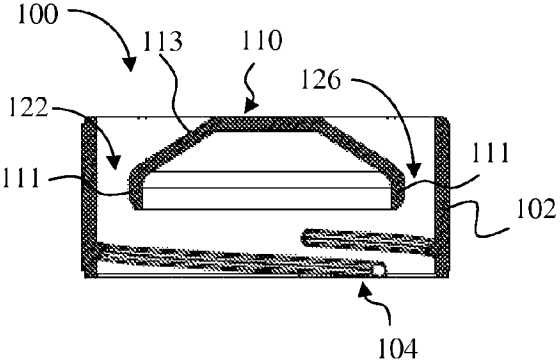
FIGS. 1D and 1E illustrate cross-sectional views of the storing and dispensing cap along lines I-I' and II-II', respectively, as shown in FIGS. 1A and 1B in accordance with an embodiment of the present disclosure.
Figure 1D:
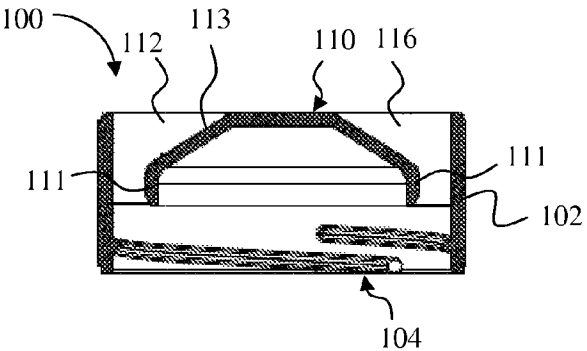
Figure 1C:
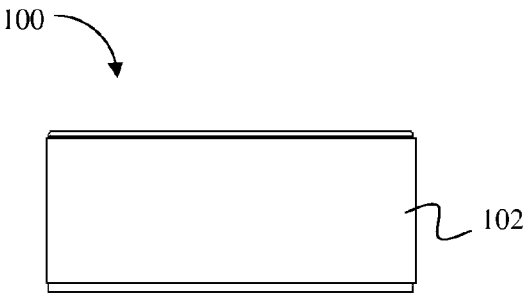

Referring now to FIGS. 1A-1E, FIG. 1A illustrates a top perspective view of a storing and dispensing cap 100 in accordance with an embodiment of the present disclosure, FIGS. 1B and 1C illustrate a top view and a side view, respectively, of the storing and dispensing cap 100 of FIG. 1A in accordance with an embodiment of the present disclosure, and FIGS. 1D and 1E illustrate cross-sectional views of the storing and dispensing cap 100 along lines I-I' and II-IF, respectively, as shown in FIGS. 1A and 1B in accordance with an embodiment of the present disclosure.

In one embodiment, cap 100 includes a housing 102 movably couplable to a container neck having a lip (e.g., a neck 252 of a container 250 in FIGS. 2A-2B, 4A-4B, and 5), a dispensing platform 110 coupled within and to the housing 102, and a dispenser opening 120 (e.g., dispenser openings 122, 124, 126, 128) between an exterior edge 111 of the dispensing platform 110 and the housing 102. The dispenser opening 120 is configured to be obstructed or plugged by the lip of the container neck when the housing 102 is coupled to the container neck, and the dispenser opening 120 is configured to be unplugged when the housing 102 is not coupled to or disengaged from the container neck.

In one embodiment, dispensing platform 110 is coupled to housing 102 by at least one rib, although four ribs 112, 114, 116, and 118 are illustrated in FIGS. 1A and 1B of this embodiment. In other embodiments, dispensing platform 110 may be coupled to housing 102 via various applicable coupling structures. For example, instead of a rib, dispensing platform 110 may be coupled along a portion of exterior edge 111 to housing 102 by horizontal extensions or other coupling structures. Combinations of different coupling structures, such as a combination of ribs and horizontal extensions, are within the scope of the present disclosure.

In a further embodiment, housing 102 has an annular form factor and includes interior screw threads 104 engageable with exterior screw threads (e.g., exterior screw threads 254 of neck 252 in FIGS. 2A-2B, 4A-4B, and 5) on a container neck.

In a further embodiment, the dispensing platform 110 includes an upper surface 113 sloped downward extending from a center area of the dispensing platform 110 toward the exterior edge 111 of the dispensing platform 110. In one example, the dispensing platform 110 has a substantially conical form factor with a flat apex directed toward the top center of the cap 100. Other form factors for the dispensing platform 110 are within the scope of the present disclosure.

Figure 4C:
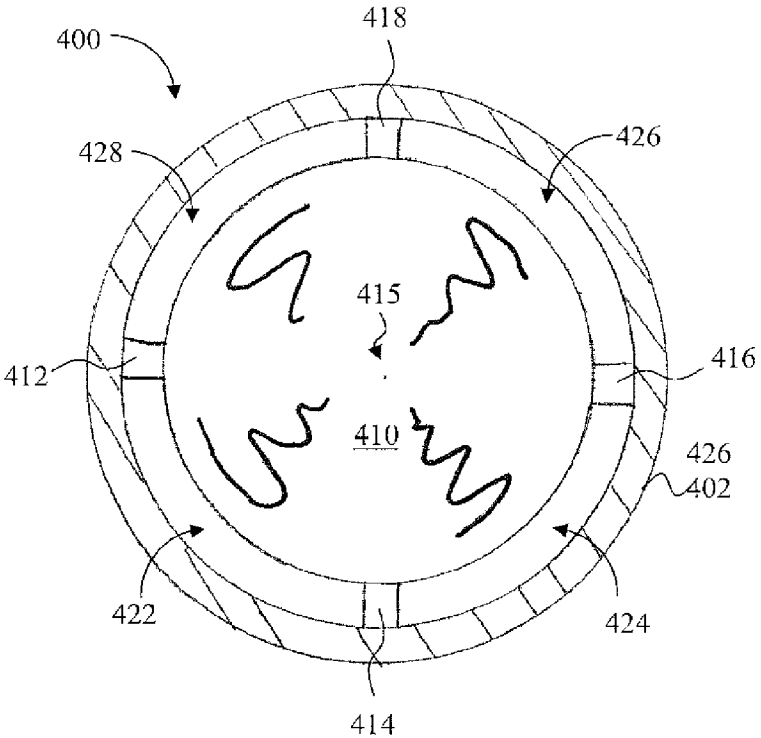
FIG. 4C illustrates a top view of the storing and dispensing cap of FIGS. 4A and 4B in accordance with an embodiment of the present disclosure.

In a further embodiment, cap 100 includes a plurality of dispenser openings 120 (e.g., dispenser openings 122, 124, 126, 128) between the exterior edge 111 of the dispensing platform and the housing 102, and in particular between the exterior edge 111 and an interior surface of housing 102. In one example, the plurality of dispenser openings 120 has an annular shape or form factor (e.g., as shown in FIG. 4C), but each dispenser opening may also have one of various geometric shapes, such as a circle (e.g., as shown in FIG. 2C). Other shapes for the dispenser openings are within the scope of the present disclosure.

In a further embodiment, each dispenser opening 120 of the plurality of dispenser openings is between adjacent ribs (e.g., between ribs 112 and 114, or between ribs 114 and 116, or between ribs 116 and 118, or between ribs 118 and 112) of the plurality of ribs 120 coupling the dispensing platform 110 to the housing 102.

The cap 100 may further include a lid (e.g., lid 206, 406, 506, or 606 of FIG. 2A-2B, 4A-4B, 5, or 6, respectively) coupled to a top of the housing 102 for providing access to an interior of the housing. Although not illustrated in this embodiment, a lid (e.g., lid 206, 406, 506, or 606 of FIG. 2A-2B, 4A-4B, 5, or 6, respectively) is operably couplable to housing 102, in one example, to access an interior space of the housing above dispensing platform 110 for provision of the second material. The lid may be coupled to housing 102 in various ways, such as by a movable joint (e.g., a hinge joint), screw threads, tabs, friction fit, snap fit, induction seal, and so on.

In accordance with various aspects of the present disclosure, cap 100 may be coupled to a neck of a container (e.g., a container 250 as shown in FIGS. 2A-2B, 4A-4B, and 5) as noted above. The container may be adapted to hold a quantity of a first material, such as a liquid (not shown) or other solvent, in an interior reservoir, and includes an opening via the neck (e.g., a neck 252 in FIGS. 2A-2B, 4A-4B, and 5), which allows access to the interior reservoir of the container and which further allows the first material (e.g., a liquid) to be supplied to or withdrawn from the container. The container may be made of various materials, and in one example may be comprised of a plastic, glass, a metal, or various chemically-inert materials. The container may have a single reservoir or alternatively may include a plurality of reservoirs to hold different materials or different amounts of the same material. In one embodiment, the container is in the shape of a bottle having a single reservoir, and the neck is cylindrical including vertical sidewalls, a top lip (e.g., a lip 256 as shown in FIGS. 2A-2B, 4A-4B, and 5), and external screw threads (e.g., external screw threads 254 as shown in FIGS. 2A-2B, 4A-4B, and 5) for operably coupling to the internal screw threads 104 of housing 102. It is noted that the container and neck may have differently configured and/or shaped walls in other embodiments. The lip of the neck may be formed to have different widths in order to fully engage with housing 102 of cap 100, and/or a portion of the lip may be raised to ensure a tight fit between the container neck and the cap.

In accordance with various aspects of the present disclosure, storing and dispensing cap 100 includes a compartment space above dispensing platform 110 (e.g., bounded by upper surface 113 of dispensing platform 110, an inner surface of housing 102, and a lid) for storing a second material (not shown), such as liquid-soluble flavorings, vitamins, minerals, enzymes, nutrients, herbs, microbial cultures, coloring agents, chemicals, etc., which is segregated from the first material in the container prior to use. The material may be stored in the compartment space above dispensing platform 110 when the dispenser openings 120 are plugged or obstructed by the lip of a container neck. When the dispenser opening is not plugged or sealed by the lip of the container neck, the material in the compartment space above dispensing platform 110 is released through the dispenser openings 120, for mixing with the first material within the container in one example.

In one example, dispensing platform 110 is generally conical in shape and is located in an interior underside of the cap 100 within housing 102. In other embodiments, the dispensing platform may be generally cylindrically-shaped or otherwise shaped differently than in a conical shape. In this embodiment, cap 100 may include multiple compartments (formed by the ribs, the dispensing platform, and the housing) to hold different second materials or different amounts of the same second material, but in other embodiments, cap 100 may include a single compartment above the dispensing platform. In yet another embodiment, the compartment space above the dispensing platform 110 can be made in different heights to accommodate different volumes of the second material and thereby provide for different mixing ratios in the arrangement. In yet another embodiment, dispensing platform can include additional vertical dividing walls (besides the ribs) within the compartment space which creates a plurality of compartments. Each compartment can hold a different material or different amounts of the same material, with each compartment having access to a corresponding dispenser opening and/or being connected to a common dispenser opening. In yet another embodiment, the housing 102 can include colorant which would create visual stimulation to the user when the materials are mixed together. Visual stimulation increases the interest in using and consuming food items. The colorant can be mixed with a clear or neutral beverage for visual entertainment while consuming the beverage.

The dispenser opening 120 allows the second material to fall from the cap 100 by gravity or user agitation when the cap 100 is not coupled to a container lip or a container neck and the dispenser opening 120 is not sealed or plugged by the container lip or the container neck, such that the second material from the cap may be mixed with the first material within the container. During storage, the dispenser opening 120 is obstructed by the container neck to completely block the dispenser opening in order to prevent a leak of the second material and the first and second materials from combining (e.g., a liquid impermeable seal may be provided).

In this embodiment, interior screw threads 104 of housing 102 may operably couple or mate to exterior screw threads (e.g., exterior screw threads 254) of a container neck (e.g., neck 252) for operably coupling cap 100 to the container neck. In one embodiment, the contact of the interior screw threads 104 and exterior screw threads may create a seal which prevents leakage from the container through the neck. However, in other embodiments, cap 100 may be operably coupled to a container neck by one of various means and techniques, such as by a slidable joint, glue, induction melting, ultrasonic melting, or the like. In such a case, cap 100 may form a seal with the container neck to prevent leakage of the first material through the neck. Such a seal may be provided by a seal ring positioned within an interior of the housing 102 of cap 100. The seal ring can be formed by a horizontal ring protruding from the bottom of the dispensing platform and extending downward towards the container neck. The seal ring is configured to contact the upper and/or interior and/or exterior circumference of the container lip (e.g., lip 256) when the cap is securely fastened onto the container lip or the container neck in order to form a seal around the circumference of the container lip. In one example, the seal ring can be formed of a soft rubbery material to create a tighter seal. Such a seal ring may be formed in conjunction with screw threads in the housing 102 as well.

In an embodiment where a screw thread is used to secure the cap 100 to the container neck, when the cap 100 is twisted open to move the cap 100 to an opened position, cap 100 including dispenser opening 120 is moved vertically-upwards away from the container neck, thus unplugging or uncoupling the dispenser opening 120 from the container neck. The second material within housing 102 may be dispensed through an unobstructed dispenser opening 120 to combine with the first material within the container. In this embodiment, additive second material may be deposited into the compartment space above the dispensing platform through the open top surface of the cap 100 after the dispenser opening is coupled to the container neck. Then the top of cap 100 can be sealed, covered, or closed (e.g., by a lid) to contain and store the additive in the compartment.

Advantageously, the device of the present disclosure permits the combination of separated ingredients by a simple single motion of opening or twisting the cap 100 relative to the container neck, and further permits the user to conveniently combine two or more ingredients without the necessity of the user contacting the ingredients directly or risking spillage or contamination of the ingredients. In accordance with various aspects of the present disclosure, cap 100 (in one example excluding the lid) including housing 102, dispensing platform 110, ribs 112-118, and dispenser openings 120 may be advantageously manufactured as a unitary member. In accordance with various aspects of the present disclosure, cap 100 may be made of various materials, and in one example may be comprised of a plastic, glass, a metal, various chemically-inert materials, and/or a combination of materials.

Figure 2B:
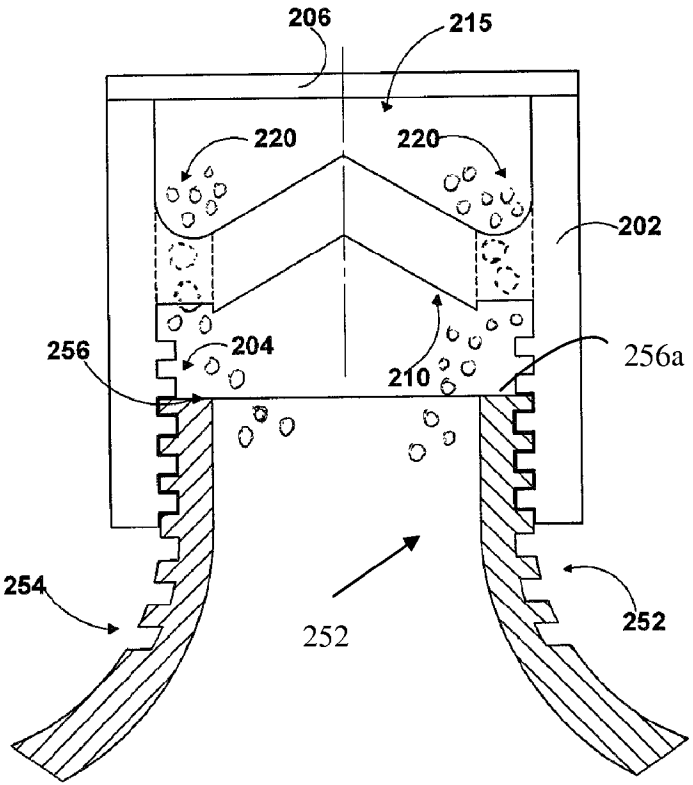
FIGS. 2A and 2B illustrate cross-sectional views of a storing and dispensing cap coupled to a container neck and uncoupled or disengaged from the container neck, respectively, in accordance with an embodiment of the present disclosure.
Figure 2A:
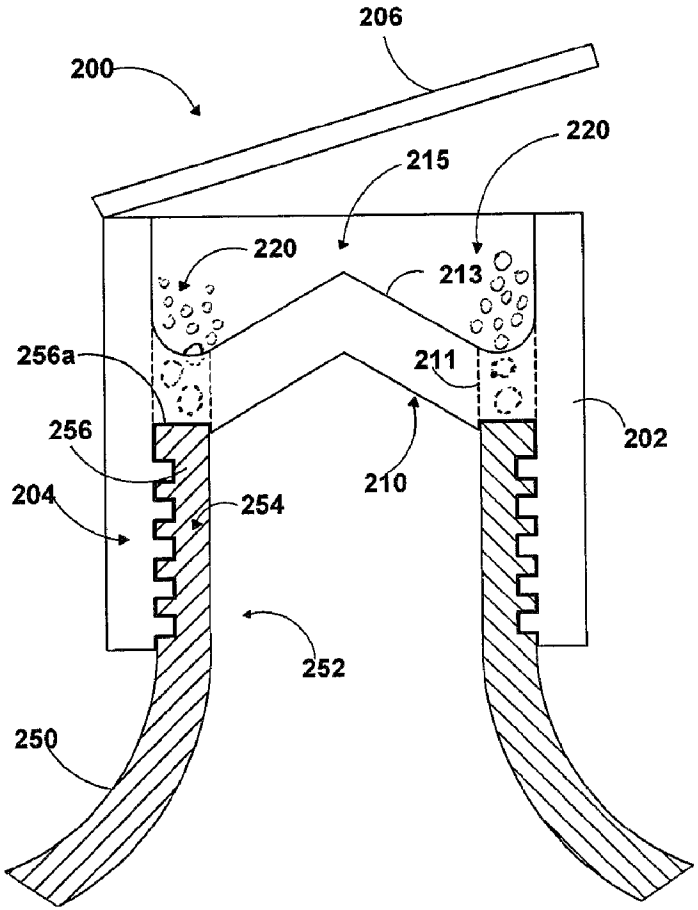
Figure 2C:
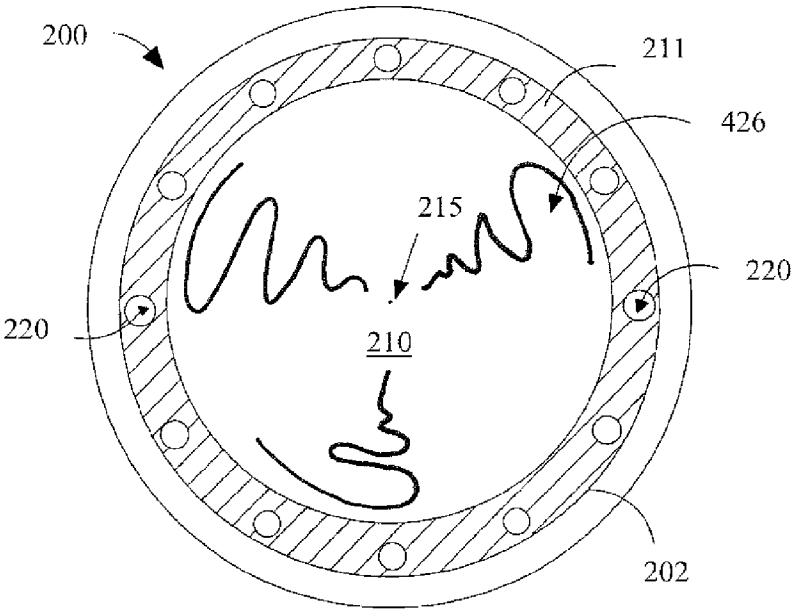
FIG. 2C illustrates a top view of the storing and dispensing cap of FIGS. 2A and 2B in accordance with an embodiment of the present disclosure.

Referring now to FIGS. 2A-2C, FIGS. 2A and 2B illustrate cross-sectional views of a storing and dispensing cap 200 coupled to a neck 252 of a container 250 and uncoupled or disengaged from the container neck 252, respectively, in accordance with an embodiment of the present disclosure. FIG. 2C illustrates a top view of the storing and dispensing cap 200 of FIGS. 2A and 2B in accordance with an embodiment of the present disclosure.

Cap 200 and container neck 252 have similar features, functionality, and variations as cap 100 and the container and neck described above with respect to FIGS. 1A-1E, and similar features are similarly numbered and applicable in this embodiment but may not be described in detail below in order to avoid repetitive descriptions.

The container 250 is adapted to hold a quantity of a first material, such as a liquid (not shown) or other solvent, in an interior reservoir, and includes an opening via the neck 252, which allows access to the interior reservoir of the container and which further allows the first material (e.g., a liquid) to be supplied to or withdrawn from the container. The container neck 252 includes a top lip 256 and external screw threads 254 for operably coupling to the cap 200. The container 250, neck 252, lip 256, and external screw threads 254 are similar to those described above with respect to FIGS. 1A-1E with similar variations being applicable.

In one embodiment, cap 200 includes a housing 202 movably couplable to container neck 252 having lip 256, a dispensing platform 210 coupled to the housing 202, and at least one dispenser opening (e.g., dispenser openings 220) between an exterior edge 211 of the dispensing platform 210 and the housing 202. The dispenser opening is configured to be plugged by the lip 256 of the container neck 252 when the housing 202 is coupled to the container neck 252, and the dispenser opening 220 is configured to be unplugged when the housing 202 is not coupled to the container neck 252.

In one embodiment, dispensing platform 210 is coupled to housing 202 by at least one rib (e.g., ribs 112, 114, 116, and/or 118 as shown in FIGS. 1A, 1B, 1D). In other embodiments, dispensing platform 210 may be coupled to housing 202 via various applicable coupling structures. For example, instead of a rib, dispensing platform 210 may be coupled along a portion of exterior edge 211 to housing 202 by horizontal extensions or other coupling structures. Combinations of different coupling structures, such as a combination of ribs and horizontal extensions are within the scope of the present disclosure.

In a further embodiment, housing 202 has an annular form factor and includes interior screw threads 204 engageable with exterior screw threads 254 on the container neck 252.

In a further embodiment, the dispensing platform 210 includes an upper surface 213 sloped downward extending from a center area of the dispensing platform 210 toward the exterior edge 211 of the dispensing platform 210. In one example, the dispensing platform 210 has a substantially conical form factor with an apex 215 directed toward the top center of the cap 100. Advantageously, a pointed apex 215 may allow for greater ease of transport of the second material through the dispenser openings. Other form factors for dispensing platform 210 are within the scope of the present disclosure.

In a further embodiment, cap 200 includes a plurality of dispenser openings 220 between the exterior edge 211 of the dispensing platform and the housing 202, and in particular between the exterior edge 211 and an interior surface of housing 202. In one example, the plurality of dispenser openings 220 may have one of various geometric shapes, such as a circle, as shown in FIG. 2C, but the plurality of openings 220 may also have an annular shape or form factor, as shown in FIG. 4C. Other shapes for the dispenser openings are within the scope of the present disclosure.

In accordance with various aspects of the present disclosure, storing and dispensing cap 200 includes a compartment space above dispensing platform 210 (e.g., bounded by an upper surface 213 of dispensing platform 210, an inner surface of housing 202, and a lid 206) for storing a second material (not shown), such as liquid-soluble flavorings, vitamins, minerals, enzymes, nutrients, herbs, microbial cultures, coloring agents, chemicals, etc., which is segregated from the first material in the container prior to use. The material may be stored in the compartment space above dispensing platform 210 when the dispenser openings 220 are plugged or obstructed by the lip of a container neck. When the dispenser opening is not plugged or sealed by the lip of the container neck, the material in the compartment space above dispensing platform 210 is released through the dispenser openings 220, for mixing with the first material within the container in one example.

An aspect that is illustrated in this embodiment is lid 206 which is operably coupled to housing 202 to access the compartment space of the housing 202 for provision of the second material. The lid 206 may be coupled to housing 202 in various ways, such as by a movable joint (e.g., a hinge joint) to rotatably move the lid relative to the housing 202, screw threads, tabs, friction fit, snap fit, and so on. Lid 206 may be moved between an opened position, as illustrated in FIG. 2A, and a closed position, as illustrated in FIG. 2B.

The dispenser opening 220 allows the second material to fall from the cap 200 by gravity or user agitation when the cap 200 is not coupled to a container lip or a container neck and the dispenser opening 220 is not sealed or plugged by the container lip or the container neck, such that the second material from the cap may be mixed with the first material within the container. During storage, the dispenser opening 220 is obstructed by the container neck to completely block the dispenser opening in order to prevent a leak of the second material and the first and second materials from combining (e.g., a liquid impermeable seal may be provided). In one embodiment, a top surface 256*a* of lip 256 seals dispenser opening 220 and is exposed to a second material within cap 200, as shown in FIGS. 2A and 2B.

FIG. 2A illustrates cap 200 coupled to container neck 252 and lid 206 in an opened position in accordance with an embodiment of the present disclosure. Interior screw threads 204 of housing 202 are operably coupled or mated to exterior screw threads 254 of container neck 252 for operably coupling cap 200 to the container neck. In one embodiment, the contact of the interior screw threads 204 and exterior screw threads 254 may create a seal which prevents leakage from the container through the neck. However, in other embodiments, cap 200 may be operably coupled to container neck 252 by one of various means and techniques, such as by a slidable joint, glue, induction melting, ultrasonic melting, or the like. In such a case, cap 200 may form a seal with the container neck to prevent leakage of the first material through the neck. Such a seal may be provided by a seal ring positioned within an interior of the housing 202 of cap 200. The seal ring can be formed by a horizontal ring protruding from the bottom of the dispensing platform and extending downward towards the container neck. The seal ring is configured to contact the upper and/or interior and/or exterior circumference of the container lip (e.g., lip 256) when the cap is securely fastened onto the container neck in order to form a seal around the circumference of the container lip. In one example, the seal ring can be formed of a soft rubbery material to create a tighter seal. Such a seal ring may be formed in conjunction with screw threads in the housing 202 as well.

FIG. 2B illustrates cap 200 partially disengaged from container neck 252 and lid 206 in a closed position in accordance with an embodiment of the present disclosure. In an embodiment where a screw thread is used to secure the cap 200 to the container neck, when the cap 200 is twisted open to move the cap 200 to an opened position, cap 200 including dispenser opening 220 is moved vertically-upwards away from the compartment neck 252, thus unplugging or uncoupling the dispenser opening 220 from neck 252 and lip 256. The second material within housing 202 may be dispensed through an unobstructed dispenser opening to combine with the first material within the container 250. In this embodiment, additive second material may be deposited into the compartment space above the dispensing platform through the open top surface of the cap 200 after the dispenser opening is coupled to the container neck. Then the top of cap 200 can be sealed, covered, or closed (e.g., by a lid) to contain and store the additive in the compartment.

In other words, when the cap 200 is actuated by the user, for example by twisting the cap or translating the cap in a vertically upward direction, dispenser opening 220 is then opened, unblocked, or disengaged such that the contents of the cap compartment can drop through the dispenser opening into the interior of the container and mix with the first material.

FIG. 2C illustrates a top view of cap 200 without a lid and illustrates dispenser openings 220 which have a circular shape or form factor in one example.

Figure 3B:
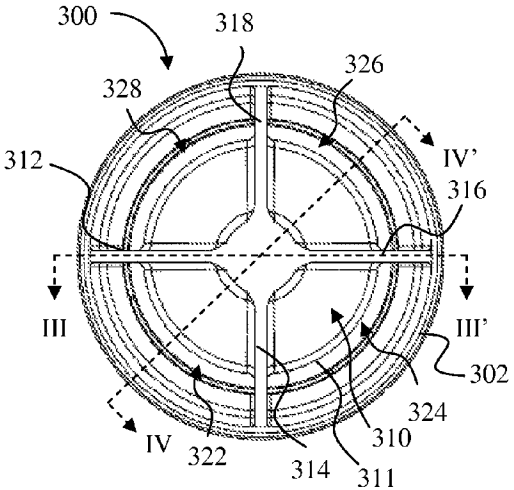
FIGS. 3B and 3C illustrate a top view and a side view, respectively, of the storing and dispensing cap of FIG. 3A in accordance with an embodiment of the present disclosure.
Figure 3A:
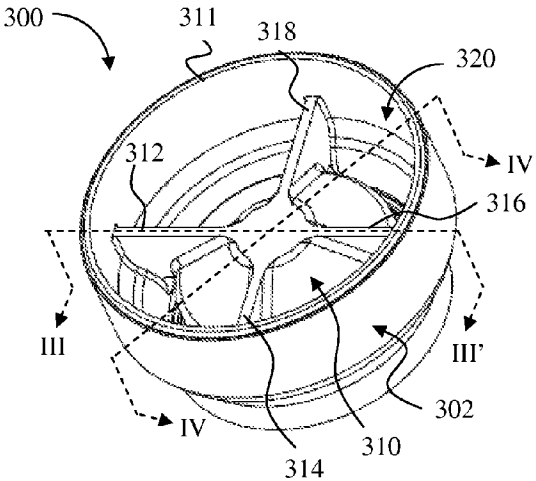
FIG. 3A illustrates a top perspective view of a storing and dispensing cap in accordance with an embodiment of the present disclosure.
Figure 3E:
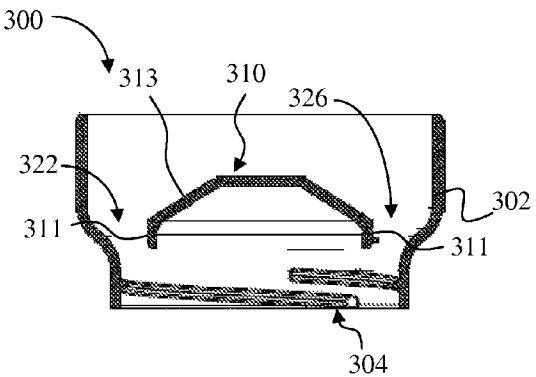
FIGS. 3D and 3E illustrate cross-sectional views of the storing and dispensing cap along lines III-III' and IV-IV', respectively, as shown in FIGS. 3A and 3B in accordance with an embodiment of the present disclosure.
Figure 3D:
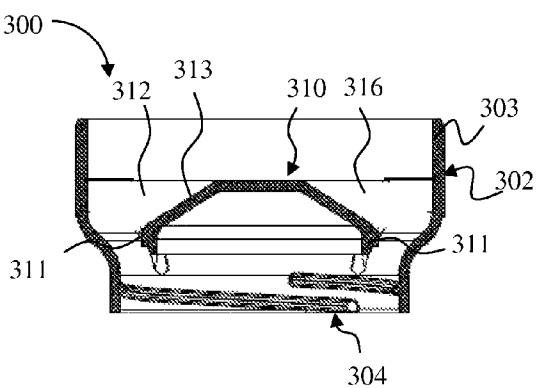
Figure 3C:
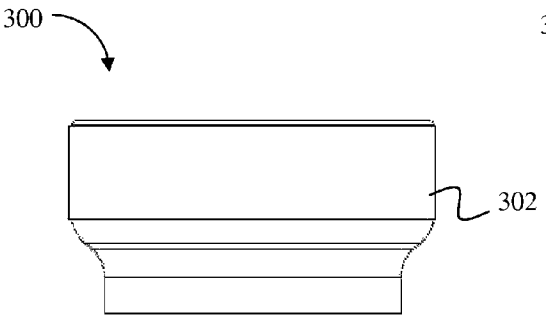

Referring now to FIGS. 3A-3E, FIG. 3A illustrates a top perspective view of a storing and dispensing cap 300 in accordance with an embodiment of the present disclosure, FIGS. 3B and 3C illustrate a top view and a side view, respectively, of the storing and dispensing cap 300 of FIG. 3A in accordance with an embodiment of the present disclosure, and FIGS. 3D and 3E illustrate cross-sectional views of the storing and dispensing cap along lines III-IIII' and IV-IV', respectively, as shown in FIGS. 3A and 3B in accordance with an embodiment of the present disclosure.

Cap 300 has similar features, functionality, and variations as caps 100 and 200 described above with respect to FIGS. 1A-1E and 2A-2B, and similar features are similarly numbered and fully applicable in this embodiment but may not be described in detail below in order to avoid repetitive descriptions.

In one embodiment, cap 300 includes a housing 302 movably couplable to a container neck having a lip (e.g., a neck 252 of a container 250 in FIGS. 2A-2B, 4A-4B, and 5), a dispensing platform 310 coupled within and to the housing 302, and a dispenser opening 320 (e.g., dispenser openings 322, 324, 326, 328) between an exterior edge 311 of the dispensing platform 310 and the housing 302. The dispenser opening 320 is configured to be obstructed or plugged by the lip of the container neck when the housing 302 is coupled to the container neck, and the dispenser opening 320 is configured to be unplugged or disengaged from the container lip when the housing 302 is not coupled to or disengaged from the container neck.

In one embodiment, dispensing platform 310 is coupled to housing 302 by at least one rib, such as ribs 312, 314, 316, and 318 as illustrated in FIGS. 3A and 3B of this embodiment. In other embodiments, dispensing platform 310 may be coupled to housing 302 via various applicable coupling structures. For example, instead of a rib, dispensing platform 310 may be coupled along a portion of exterior edge 311 to housing 302 by horizontal extensions or other coupling structures. Combinations of different coupling structures, such as a combination of ribs and horizontal extensions, are within the scope of the present disclosure.

In a further embodiment, housing 302 has an annular form factor and includes interior screw threads 304 engageable with exterior screw threads (e.g., exterior screw threads 254 of neck 252 in FIGS. 2A-2B, 4A-4B, and 5) on a container neck.

In a further embodiment, the dispensing platform 310 includes an upper surface 313 sloped downward extending from a center area of the dispensing platform 310 toward the exterior edge 311 of the dispensing platform 310. In one example, the dispensing platform 310 has a substantially conical form factor with a flat apex directed toward the top center of the cap 100. Other form factors for the dispensing platform 310 are within the scope of the present disclosure, such as a conical form factor with a pointed apex as shown in FIGS. 2A-2B and 4A-4B.

In a further embodiment, cap 300 includes a plurality of dispenser openings 320 (e.g., dispenser openings 322, 324, 326, 328) between the exterior edge 311 of the dispensing platform and the housing 302, and in particular between the exterior edge 311 and an interior surface of housing 302. In one example, the plurality of dispenser openings 320 has an annular shape or form factor, but may also have one of various geometric shapes, such as a circle. Other shapes for the dispenser openings are within the scope of the present disclosure.

In a further embodiment, each dispenser opening 320 of the plurality of dispenser openings is between adjacent ribs (e.g., between ribs 312 and 314, or between ribs 314 and 316, or between ribs 316 and 318, or between ribs 318 and 312) of the plurality of ribs 320 coupling the dispensing platform 310 to the housing 302.

The cap 300 may further include a lid (e.g., lid 206, 406, 506, or 606 of FIG. 2A-2B, 4A-4B, 5, or 6, respectively) coupled to a top of the housing 302 for providing access to an interior of the housing.

In accordance with various aspects of the present disclosure, cap 300 may be coupled to a neck of a container (e.g., a container 250 as shown in FIGS. 2A-2B, 4A-4B, and 5) as noted above.

In accordance with various aspects of the present disclosure, storing and dispensing cap 300 includes a compartment space above dispensing platform 310 (e.g., bounded by upper surface 313 of dispensing platform 310, an inner surface of housing 302, and a lid) for storing a second material (not shown), such as liquid-soluble flavorings, vitamins, minerals, enzymes, nutrients, herbs, microbial cultures, coloring agents, chemicals, etc., which is segregated from the first material in the container prior to use. The material may be stored in the compartment space above dispensing platform 310 when the dispenser openings 320 are plugged or obstructed by the lip of a container neck. When the dispenser opening is not plugged or sealed by the lip of the container neck, the material in the compartment space above dispensing platform 310 is released through the dispenser openings 320, for mixing with the first material within the container in one example.

In one example, dispensing platform 310 is generally conical in shape with a flat apex and is located in an interior underside of the cap 300 within housing 302. Other form factors or shapes for the dispensing platform 310 are within the scope of the present disclosure, such as a conical form factor with a pointed apex as shown in FIGS. 2A-2B and 4A-4B.

The dispenser opening 320 allows the second material to fall from the cap 300 by gravity or user agitation when the cap 300 is not coupled to a container lip or a container neck and the dispenser opening 320 is not sealed or plugged by the container lip or the container neck, such that the second material from the cap may be mixed with the first material within the container. During storage, the dispenser opening 320 is obstructed by the container lip or the container neck to completely block the dispenser opening in order to prevent a leak of the second material and the first and second materials from combining (e.g., a liquid impermeable seal may be provided).

In this embodiment, housing 302 includes sidewalls 311 that extend above dispensing platform 310 and which also extend to have a greater width than housing 102 or 202, which have vertical sidewalls. Housing 202 also has vertical sidewalls above dispensing platform 210. Housing 302 includes vertical sidewalls 311 above dispensing platform 310 and outwardly extending sidewalls below vertical sidewalls 311. Accordingly, housing 302 has a larger compartment space than housings 102 or 202, and housing 202 has a larger compartment space than housing 102, in one example.

Figure 4B:
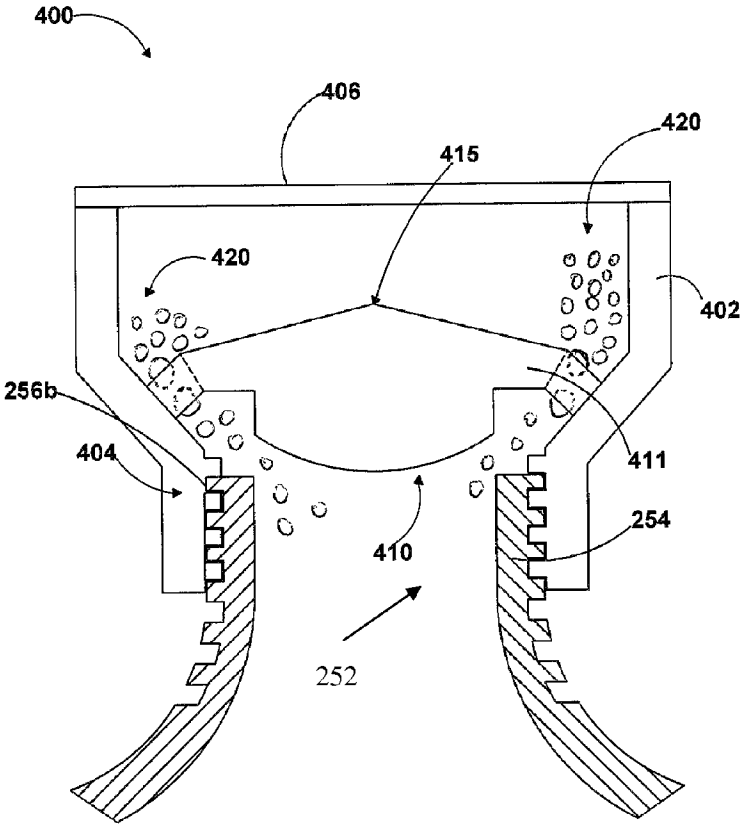
FIGS. 4A and 4B illustrate cross-sectional views of a storing and dispensing cap coupled to a container neck and uncoupled or disengaged from the container neck, respectively, in accordance with an embodiment of the present disclosure.
Figure 4A:
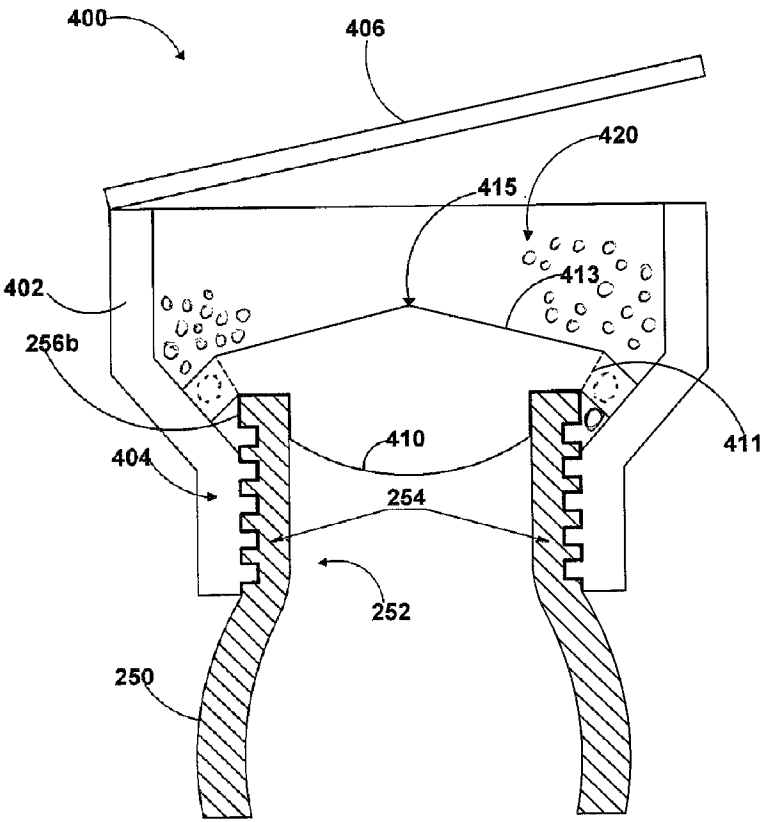

Referring now to FIGS. 4A-4C, FIGS. 4A and 4B illustrate cross-sectional views of a storing and dispensing cap 400 coupled to a neck 252 of a container 250 and partially uncoupled or disengaged from the container neck 252, respectively, in accordance with an embodiment of the present disclosure. FIG. 4C illustrates a top view of the storing and dispensing cap 400 of FIGS. 4A and 4B in accordance with an embodiment of the present disclosure.

Cap 400 has similar features, functionality, and variations as caps 100, 200, and 300 described above with respect to FIGS. 1A-1E, 2A-2B, and 3A-3E, respectively, and similar features are similarly numbered and fully applicable in this embodiment but may not be described in detail below in order to avoid repetitive descriptions.

The container 250 is adapted to hold a quantity of a first material, such as a liquid (not shown) or other solvent, in an interior reservoir, and includes an opening via the neck 252, which allows access to the interior reservoir of the container and which further allows the first material (e.g., a liquid) to be supplied to or withdrawn from the container. The container neck 252 includes a top lip 256 and external screw threads 254 for operably coupling to the cap 200. The container 250, neck 252, lip 256, and external screw threads 254 are similar to those described above with respect to FIGS. 1A-1E with similar variations being applicable.

In one embodiment, cap 400 includes a housing 402 movably couplable to container neck 252 having lip 256, a dispensing platform 410 coupled to the housing 402, and at least one dispenser opening (e.g., dispenser openings 420) between an exterior edge 411 of the dispensing platform 410 and the housing 402. The dispenser opening is configured to be plugged by the lip 256 of the container neck 252 when the housing 402 is coupled to the container neck 252, and the dispenser opening 420 is configured to be unplugged when the housing 402 is not coupled to the container neck 252. In one embodiment, a sidewall surface 256*b* of lip 256 seals dispenser opening 420 and is exposed to a second material within cap 400, as shown in FIGS. 4A and 4B.

In one embodiment, dispensing platform 410 is coupled to housing 402 by at least one rib (e.g., ribs 312, 314, 316, and/or 318 as shown in FIGS. 3A, 3B, 3D). In other embodiments, dispensing platform 410 may be coupled to housing 402 via various applicable coupling structures.

In a further embodiment, housing 402 has an annular form factor and includes interior screw threads 404 engageable with exterior screw threads 254 on the container neck 252.

In a further embodiment, the dispensing platform 410 includes an upper surface 413 sloped downward extending from a center area of the dispensing platform 410 toward the exterior edge 411 of the dispensing platform 410. In one example, the dispensing platform 410 has a substantially conical form factor with an apex 415 directed toward the top center of the cap 400.

In a further embodiment, cap 400 includes a plurality of dispenser openings 420 between the exterior edge 411 of the dispensing platform and the housing 402, and in particular between the exterior edge 411 and an interior surface of housing 402. In one example, the plurality of dispenser openings 420 may have an annular shape or form factor, as shown in FIG. 4C. Other shapes for the dispenser openings are within the scope of the present disclosure.

In accordance with various aspects of the present disclosure, storing and dispensing cap 400 includes a compartment space above dispensing platform 410 (e.g., bounded by an upper surface 413 of dispensing platform 410, an inner surface of housing 402, and a lid 406) for storing a second material (not shown), such as liquid-soluble flavorings, vitamins, minerals, enzymes, nutrients, herbs, microbial cultures, coloring agents, chemicals, etc., which is segregated from the first material in the container prior to use. The material may be stored in the compartment space above dispensing platform 410 when the dispenser openings 420 are plugged or obstructed by the lip of a container neck. When the dispenser opening is not plugged or sealed by the lip of the container neck, the material in the compartment space above dispensing platform 410 is released through the dispenser openings 420, for mixing with the first material within the container in one example.

FIG. 4A illustrates cap 400 coupled to container neck 252 and lid 406 in an opened position in accordance with an embodiment of the present disclosure. Interior screw threads 404 of housing 402 are operably coupled or mated to exterior screw threads 254 of container neck 252 for operably coupling cap 400 to the container neck. In one embodiment, the contact of the interior screw threads 404 and exterior screw threads 254 may create a seal which prevents leakage from the container through the neck. However, in other embodiments, cap 400 may be operably coupled to container neck 252 by one of various means and techniques, such as by a slidable joint, glue, induction melting, ultrasonic melting, or the like. In such a case, cap 400 may form a seal with the container neck or lip to prevent leakage of the first material through the neck.

FIG. 4B illustrates cap 400 disengaged from container neck 252 and lid 406 in a closed position in accordance with an embodiment of the present disclosure. In an embodiment where a screw thread is used to secure the cap 400 to the container neck, when the cap 400 is twisted open to move the cap 400 to an opened position, cap 400 including dispenser opening 420 is moved vertically-upwards away from the container neck 252, thus unplugging or uncoupling the dispenser opening 420 from neck 252 and lip 156. The second material within housing 402 may be dispensed through an unobstructed dispenser opening to combine with the first material within the container 250. In this embodiment, additive second material may be deposited into the compartment space above the dispensing platform through the open top surface of the cap 400 after the dispenser opening is coupled to the container neck. Then the top of cap 400 can be sealed, covered, or closed (e.g., by lid 406) to contain and store the additive in the compartment.

FIG. 4C illustrates a top view of the cap 400 without a lid and shows the plurality of dispenser openings 420 (e.g., dispenser openings 422, 424, 426, and 428) having an annular shape or form factor in one example.

In this embodiment, cap 300 and 400 each include a dispensing platform 310 and 410 that has a sealing lip or notch 311 and 411, respectively, engageable with the lip 256 of the container neck 252. Further, housing 302 and 402 may each include housing sidewalls that extend outwardly from the dispensing platform to provide a greater compartment space above the dispensing platform.

Figure 6:
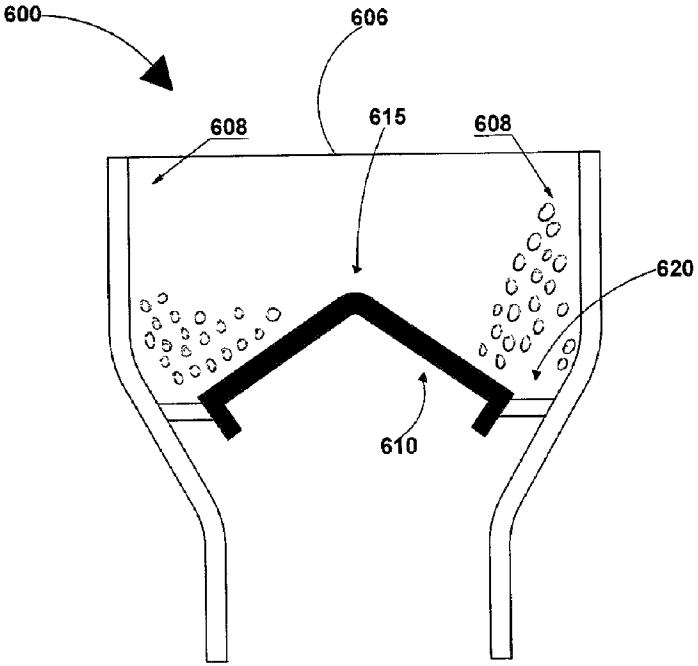
FIG. 6 illustrates a cross-sectional view of a storing and dispensing cap in accordance with another embodiment of the present disclosure.
Figure 5:
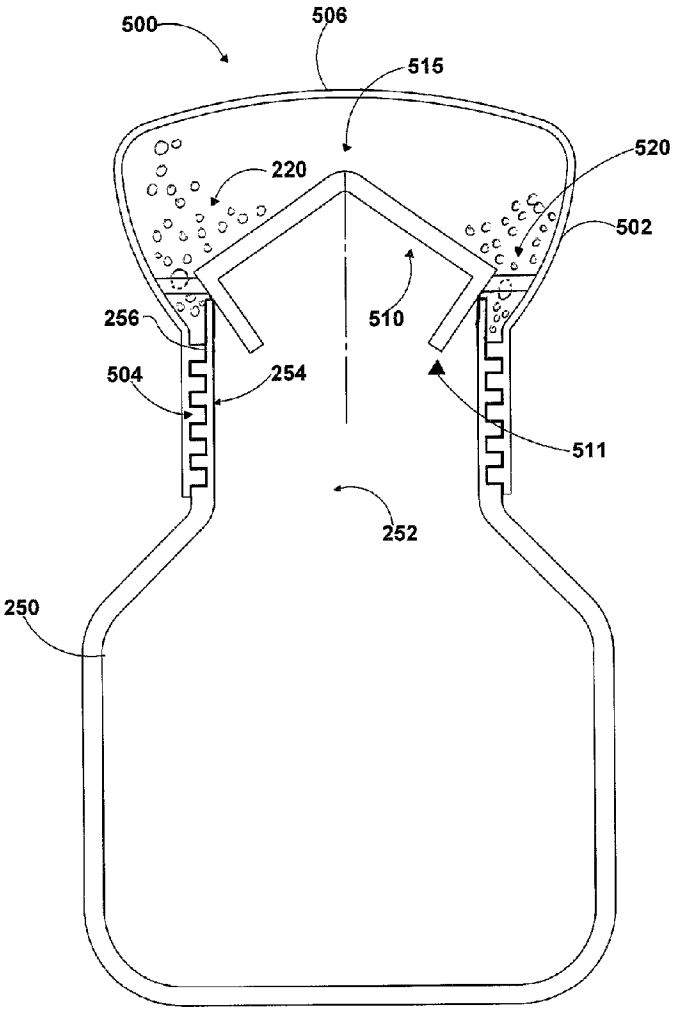
FIG. 5 illustrates a cross-sectional view of a storing and dispensing cap coupled to a container neck in accordance with another embodiment of the present disclosure.

Referring now to FIG. 5, a cross-sectional view is illustrated of a storing and dispensing cap 500 coupled to a neck 252 of a container 250 in accordance with another embodiment of the present disclosure. FIG. 6 illustrates a cross-sectional view of a storing and dispensing cap 600 in accordance with another embodiment of the present disclosure.

Caps 500 and 600 have similar features, functionality, and variations as caps 100, 200, 300, and 400 described above with respect to FIGS. 1A-1E, 2A-2C, 3A-3E, and 4A-4C, respectively, and similar features are similarly numbered and fully applicable in these embodiments but may not be described in detail below in order to avoid repetitive descriptions.

Cap 500 illustrates inwardly-sloped sealing lips 511 to provide a tighter seal with lip 256 and neck 252 of container 250. Cap 600 illustrates the housing sidewalls of housing 602 extending above the dispensing platform 610 to provide for greater compartment space for the second material above the dispensing platform, as also noted above with respect to FIGS. 2A-2C, 3A-3E, and 4A-4C.

According to various aspects of the present disclosure, a closure device (e.g., cap 100, 200, 300, 400, 500, or 600) is disclosed which fits upon a container (e.g., container 250) and provides for the separate storage of at least two materials and the admixing of the materials upon separation of the closure device from the container.

In one embodiment, the container has an outlet and holds a quantity of a first material, such as a liquid. The container may include a closure device (such as a screw type bottle cap), with the closure device being adapted to close the outlet of the container. The closure device may incorporate a compartment for storing a second material such as flavorings, vitamins, minerals, enzymes, nutrients, chemicals, coloring agents, microbial cultures, etc., which is segregated from the first material prior to use. The compartment may be located in the interior of the closure device and may be manufactured as a unitary member of the closure device or as a separate unit. When the closure device is fully fastened onto the container, the bottle lip may contact the bottom surface of the base of the compartment.

The base of the compartment may have one or more openings (e.g., dispenser openings 120, 220, 320, 420, 520, or 620) which may be positioned along the exterior circumference of the compartment base, so that the openings provide a pathway from the interior of the compartment to the interior of the container. The purpose of the openings is to allow material stored in the compartment to fall down through the openings into the interior of the container. When the openings are not obstructed, the second material in the compartment may drop through said openings and admix with the first material in the container. The openings may be obstructed until the user is ready to admix the materials.

The openings may be positioned so that when the closure device is fully fastened atop of the container, the openings may be obstructed by the outlet orifice of the container (also commonly called the lip of the bottle). The lip of the bottle may block the openings when the closure device is fully secured on top of the container. When the closure device is separated from the container, the openings become unobstructed, and the contents of the compartment may fall by operation of gravity through the openings into the container and admix with the first material.

The openings may be located along the circumference of the base of the compartment, and more specifically, in the area of the compartment base which contacts the uppermost surface of the bottle lip when the closure device is fastened onto the container. Accordingly, in one example, the openings may be obstructed by the width of the uppermost surface of the bottle lip, and such width may completely block the openings in order to prevent the first and second material from combining.

When the closure device is securely fastened onto the container outlet, the base of the compartment may be in contact with the lip of the bottle, and the openings may be placed on the base of the compartment in the location such contact. By locating the openings where the bottle lip and the base of the compartment make contact, the bottle lip can obstruct the openings by such contact. When the closure device is unfastened, it moves upwards away from the bottle lip, thereby disengaging said bottle lip from the openings and causing the openings to become unblocked.

If the closure device is attached to the container with a screw-type engagement, the user will twist open the closure device which will cause the lip of the container to disengage from the base of the compartment, and unblock the openings. When the bottle lip becomes disengaged from the closure device, it is no longer blocking the openings, and allows the material in the compartment to flow through the openings and allows such material to mix with the material in the container.

In one embodiment, the container may be in the shape of a bottle having an outlet orifice and container interior, and wherein the closure is of the bottle cap type, the compartment being cylindrically shaped with the upper surface of the base being shaped as a cone with the highest point of the cone being at the center of the base, with a plurality of openings along the bottom circumference of the compartment base.

In another embodiment, the openings can be positioned so the outer edge of the bottle lip is blocking the material in the compartment from dropping into the container. If the openings are blocked by the uppermost top surface of the container lip, then the size of the openings are limited to the width of the container lip. If the openings are positioned to be blocked by the outer edge of the container lip, then there is no such constraint on the size of the opening. In this embodiment, the container lip will contact the base of the compartment, and the interior walls of the closure device will extend outwards (away from the center) in the vicinity where the compartment base contacts the container lip. Since the base of the compartment has a smaller circumference than the walls of the closure device, there is a gap created between the outer edge of the compartment base and the interior surface of the closure device. When the container lip is contacting the bottom surface of the compartment base, the gap is blocked by the container lip. When the closure device is separated from the container lip, the gap is no longer blocked, allowing the contents of the compartment to fall down into the interior of the container. The compartment base can be connected to the interior of the closure device with one or more supporting rods.

In another embodiment of the disclosure, the opening can be shaped as holes that are vertical, or can be angled in a manner to cause the contents of the compartment to fall inwards and towards the center of the container, or the opening can be a gap. This gap is created by having the interior walls of the closure device extend beyond the circumference of the compartment base, and the compartment base would be attached to the interior walls of the compartment with one or more supporting rods. In other words, the interior wall of the closure device would have a circumference which is greater than the circumference of the compartment base, thereby leaving space (or a gap) between the compartment base and the interior walls of the closure device.

In another embodiment of the disclosure, if a screw thread is used to secure the closure device to the container, then when the closure device is twisted open it will cause a vertically-upward movement of said closure device. Such vertically-upward movement will cause the lip of the container to disengage from the closure device. Upon disengagement, the openings of the compartment base will no longer be blocked by the lip of the container, and the second material will drop down and combine with the first material.

In another embodiment of the disclosure, the compartment can be made in different heights to accommodate different volumes of the ingredients and thereby providing different mixing ratios in the arrangement.

In another embodiment, the compartment can be attached to the closure device by glue, induction melting, ultrasonic melting, or the like.

In another embodiment of the disclosure, the outlet orifice of the container (lip of the bottle) can be made in different widths in order to fully engage with the openings, or a portion of the lip can be made wider to further assist in the obstructing of the openings.

In another embodiment of the disclosure, the lip of the container can be made of a deformable material to ensure a liquid impermeable seal with the openings.

In another embodiment of the disclosure, the bottom surface of the compartment base (or dispensing platform) can be indented so that the bottle lip will fit snugly into the indentation, to ensure a stronger liquid impermeable seal. In another embodiment, the bottom surface of the compartment base (or dispensing platform) can be sloped inwardly becoming narrower at the base of the sealing ring so that the bottle lip contacting the sloped surface of the sealing ring will create a stronger liquid impermeable seal.

In another embodiment of the disclosure, the closure device can be formed as a hollow body, with the bottom end consisting of the dispenser opening, and the other end consisting of the top of the closure device that is open and unsealed. During manufacture, the closure device can be attached to the container, and with the container lip obstructing the openings on the base of the compartment, the additive can be deposited into the compartment from the top of the closure device. Then, the top surface of the closure device can be sealed, covered, or closed to contain and store the additive in the compartment. The top surface of the closure device can also be hingedly connected.

In another embodiment of the disclosure, the compartment can contain vertical dividing walls within the compartment which allow the creation of a plurality of compartments. Each compartment can contain a different material, with each compartment having access and being connected to one or more openings.

In another embodiment of the disclosure, the compartment can include colorant which would create visual stimulation to the user when the materials are mixed together. Visual stimulation increases the interest in using and consuming food items. The colorant can be mixed with a clear or neutral beverage for visual entertainment while consuming the beverage.

In yet another embodiment of the disclosure, a method of storing and mixing is provided. The method includes providing a container including a reservoir and a neck having a lip, and providing a storing and dispensing cap. The storing and dispensing cap includes a housing movably couplable to the neck, a dispensing platform coupled to the housing, and a dispenser opening between an exterior edge of the dispensing platform and the housing. The method further includes coupling the housing of the cap to the neck to plug the dispenser opening with the lip of the neck.

In other embodiments, a method of storing and mixing further includes uncoupling the housing and the neck to unplug the plurality of dispenser openings from the lip of the neck, providing a first material in the reservoir and providing a second material in the housing through a top opening of the housing accessible via a movable lid, and/or dispensing the second material out of the housing through the plurality of dispenser openings and into the reservoir holding the first material.

In other embodiments, a storage/dispensing closure for a container is disclosed. In one embodiment, the closure comprises a body, and a coupling section defined in the body, configured to movably couple the body to an opening defined by a lip on the container between a fully coupled position to a less than fully coupled position. The closure further includes a storage section defined in the body in flow communication with the coupling section via a dispensing opening. The dispensing opening is sealed by the lip when the body is in the fully coupled position, and the dispensing opening is not sealed by the lip when the body is in the less than fully coupled position, thereby permitting flow communication between the storage section and the coupling section and into the container.

In accordance with various aspects of the present disclosure, the coupling section may define a twist-off coupling, a threaded coupling, and/or a slidable coupling.

In accordance with various aspects of the present disclosure, the compartment may comprise a compartment having a base defining the dispensing opening. The base may comprise a platform that slopes towards the dispensing opening to facilitate dropping of substance stored in the compartment through the dispensing opening. The platform may slope from a center to an end of the platform. The dispensing opening may comprise a plurality of openings evenly distributed with respect to the base.

In accordance with various aspects of the present disclosure, the storage section may comprises a wall and a base defining the compartment, wherein the dispensing opening is located at the edge of the base near the wall. The wall may extend to define the coupling section. An interior surface of the wall at the coupling section may be threaded. The storage section may further comprise a lid sealing the compartment on a side away from the coupling section.

Advantageously, the present disclosure provides a package including a storing and dispensing cap that can be coupled to a container such that two or more separate products may be contained in a separated condition. Means are also provided for separately storing at least two materials or ingredients of a product within a cap prior to opening of the container and which, upon opening of the container closure, provides for the automatic admixing of the separately stored materials. The present disclosure further provides for longer storage times of materials which would degrade if mixed together by providing for separate storage compartments for each such material. In such case, the two compounds may be mixed together to form the desired product shortly before use in order to preserve efficacy. The present disclosure may also obviate the need to refrigerate ingredients to preserve efficacy. The present disclosure further permits a reactive compound and a base compound to be sold as part of the same package. From an aesthetic as well as a handling standpoint, it is desirable that a single package be utilized for separately maintaining such compounds. The present disclosure further permits combining of the ingredients by a simple single motion of opening the closure device. The present disclosure further provides a means for maintaining properly proportioned amounts of the ingredients in one package, so that the user may easily and quickly mix proper amounts in an accurate and uniform manner, and very quickly and economically within a prepackaged container. The present disclosure further provides a storing and dispensing cap which may be easily manufactured or fabricated from readily available materials and which is relatively inexpensive and relatively fool-proof in use. The present disclosure further provides an improved device permitting the user to conveniently combine two or more ingredients without the necessity of contacting the ingredients used and without the risk of spillage. The present disclosure further provides a package for storing and mixing a plurality of ingredients with a minimum of time and effort. The present disclosure further provides a novel package for storing, mixing and then dispensing ingredients with little or no danger of contamination. The present disclosure further provides for the conservation of resources and decreases manufacturing time and costs with the use of less materials. The present disclosure also provides a sealing device that is solidly supported in a position to prevent any mixture between the separated ingredients until intended. The present disclosure further provides a method for proportioning ingredients for the purpose of accurate and expeditious mixing immediately prior to use. The present disclosure further provides for the release of pressure which may result from the combining of the ingredients because the single action of removing the cap which causes the combining of the ingredients will also cause air to enter the container. The present disclosure further provides a container which is simple to construct, easy to operate both as to filling with the separated ingredients and as to discharge of the mixed product, and which embodies certain safety features which protect against accidental, premature mixing of the separated ingredients, and against accidental discharge of the mixed product. The present disclosure further keeps the sealing device from getting wet during the bottling process when liquid is poured into the container.

Although several embodiments of the invention have been described herein in detail, the teachings of the present invention will suggest many other embodiments to those skilled in the art. For instance, although only two separately stored ingredients for a product are shown and described in the disclosed embodiments, it should be apparent to one skilled in the art that embodiments fall within the scope of the invention wherein three or more materials may be separately stored and automatically admixed upon or preceding opening of the container. For example, the cap compartments and/or the container reservoirs may be sectioned to include space for separately storing more than one material in each cap compartment and/or container reservoir. Furthermore, the device of the present disclosure may be used to separately store various materials, including but not limited to foodstuff, drugs, dyes, cosmetics, pharmaceuticals, vitamins, minerals, enzymes, nutrients, herbs, flavorings, and other chemicals. While this invention is susceptible of embodiment in many different forms, this specification and the accompanying drawings disclose only some specific forms as examples of the invention. The invention is not intended to be limited to the embodiments so described, however. It should also be understood that numerous modifications and variations are possible in accordance with the principles of the present invention. Accordingly, the scope of the invention is defined only by the following claims.

What is claimed is:

1. A storing and dispensing cap, comprising:

a housing movably couplable to a container neck of a container having a lip;

a dispensing platform coupled to the housing; and a peripheral dispenser opening between an exterior edge of the dispensing platform and the housing, wherein the dispenser opening is configured to be plugged by the lip of the container neck when the housing is coupled to the container neck, and wherein the dispenser opening is configured to be unplugged when the housing is not coupled to the container neck;

wherein said lip of the container neck of said container provides an impermeable seal between said storing and dispensing cap and said container when plugged to said storing and dispensing cap, and further wherein a mixing material is located inside said storing and dispensing cap when plugged.

2. The cap of claim 1, wherein the housing is annular and includes interior screw threads engageable with exterior screw threads on the container neck.

3. The cap of claim 1, wherein the dispensing platform includes an upper surface sloped downward extending from a center of the dispensing platform toward the exterior edge of the dispensing platform.

4. The cap of claim 1, wherein the dispensing platform is cone-shaped.

5. The cap of claim 1, wherein the dispensing platform includes a sealing lip engageable with the lip of the container neck or a notch engageable with the lip of the container neck.

6. The cap of claim 1, further comprising a plurality of dispenser openings between the exterior edge of the dispensing platform and the housing, wherein the plurality of dispenser openings have an annular shape or each dispenser opening of the plurality of dispenser openings has a geometric shape of a circle.

7. The cap of claim 6, wherein each dispenser opening of the plurality of dispenser openings is between adjacent ribs of a plurality of ribs coupling the dispensing platform to the housing.

8. The cap of claim 1, further comprising a lid coupled to a top of the housing for providing access to an interior of the housing.

9. A storing and mixing system, comprising a container including a reservoir and a neck having a lip; and a storing and dispensing cap removably couplable to the neck, the cap including:

a housing movably couplable to the neck;

a dispensing platform coupled to the housing by a plurality of ribs; and a plurality of peripheral dispenser openings between an exterior edge of the dispensing platform and the housing, wherein the plurality of dispenser openings are configured to be plugged by the lip of the container neck when the housing is coupled to the container neck, and wherein the plurality of dispenser openings are configured to be unplugged when the housing is not coupled to the container neck;

wherein said lip of the container neck of said container provides an impermeable seal between said storing and dispensing cap and said container when plugged to said storing and dispensing cap and further wherein a mixing material is located inside said storing and dispensing cap when plugged.

10. The system of claim 9, wherein the housing is similar and includes interior screw threads engageable with exterior screw threads on the neck.

11. The system of claim 9, wherein the dispensing platform includes an upper surface sloped downward extending from a center of the dispensing platform toward the exterior edge of the dispensing platform.

12. The system of claim 9, wherein the dispensing platform is cone-shaped.

13. The system of claim 9, wherein the dispensing platform includes a sealing lip engageable with the lip of the container neck or a notch engageable with the lip of the container neck.

14. The system of claim 9, wherein the plurality of dispenser openings have an annular shape or each dispenser opening of the plurality of dispenser openings has a geometric shape of a circle.

15. The system of claim 9, wherein each dispenser opening of the plurality of dispenser openings is between adjacent ribs of the plurality of ribs coupling the dispensing platform to the housing.

16. The system of claim 9, wherein the cap further comprises a lid coupled to a top of the housing for providing access to an interior of the housing.

17. A method of storing and mixing, the method comprising:

providing a container including a reservoir and a neck having a lip;

providing a storing and dispensing cap including:

a housing movably couplable to the neck;

a dispensing platform coupled to the housing; and a peripheral dispenser opening between an exterior edge of the dispensing platform and the housing; and coupling the housing of the cap to the neck to plug the dispenser opening with the lip of the neck;

wherein said lip of the container neck of said container provides an impermeable seal between said storing and dispensing cap and said container when plugged to said storing and dispensing cap, and further wherein a mixing material is located inside said storing and dispensing cap when plugged.

18. The method of claim 17, further comprising uncoupling the housing and the neck to unplug a plurality of dispenser openings from the lip of the neck.

19. The method of claim 17, further comprising providing a first material in the reservoir and providing a second material in the housing through a top opening of the housing accessible via a movable lid.

20. The method of claim 19, further comprising dispensing the second material out of the housing through the plurality of dispenser openings and into the reservoir holding the first material.

21. A storage/dispensing closure for a container, comprising:

a body;

a coupling section defined in the body, configured to movably couple the body to an opening defined by a lip on the container between a fully coupled position to a less than fully coupled position; and a storage section defined in the body in flow communication with the coupling section via peripheral dispensing opening, wherein the dispensing opening is sealed by the lip when the body is in the fully coupled position, and the dispensing opening is not sealed by the lip when the body is in the less than fully coupled position, thereby permitting flow communication between the storage section and the coupling section and into the container; and wherein said lip of the container neck of said container provides an impermeable seal between said storing and dispensing disclosure and said container when plugged to said storing and dispensing cap, and further wherein a mixing material is located inside said storing and dispensing cap when plugged.

22. The closure of claim 21, wherein the coupling section defines a twist-off coupling.

23. The closure of claim 21, wherein the coupling section defines threaded coupling.

24. The closure of claim 21, wherein the coupling section defines a slidable coupling.

25. The closure of claim 21, wherein a compartment comprises a compartment having a base defining the dispensing opening.

26. The closure of claim 25, wherein the base comprises a platform that slopes towards the dispensing opening to facilitate dropping of substance stored in the compartment through the dispensing opening.

27. The closure of claim 26, wherein the platform slopes form a center to an end of the platform.

28. The closure of claim 21, wherein a substance comprises at least one of granular or liquid structure.

29. The closure of claim 21, wherein the dispensing opening comprises a plurality of openings evenly distributed with respect to the base.

30. The closure of claim 21, wherein the storage section comprises a wall and a base defining the compartment, and wherein the dispensing opening is located at the edge of the base near the wall.

31. The closure of claim 30, wherein the wall extends to define the coupling section.

32. The closure of claim 31, wherein an interior surface of the wall at the coupling section is threaded.

33. The closure of claim 30, wherein the storage section further comprises a lid sealing the compartment on a side away from the coupling section.

* * * * *